US008416142B2

(12) United States Patent
Göttl

(10) Patent No.: US 8,416,142 B2
(45) Date of Patent: Apr. 9, 2013

(54) DUAL-POLARIZED GROUP ANTENNA

(75) Inventor: Maximilian Göttl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 706 days.

(21) Appl. No.: 12/642,022

(22) Filed: Dec. 18, 2009

(65) Prior Publication Data

US 2011/0148730 A1 Jun. 23, 2011

(51) Int. Cl.
*H01Q 21/26* (2006.01)

(52) U.S. Cl.
USPC ..... 343/797; 343/893

(58) Field of Classification Search ..... 343/797, 343/844, 853, 893
See application file for complete search history.

(56) References Cited

U.S. PATENT DOCUMENTS

| | | | | |
|---|---|---|---|---|
| 6,211,841 | B1 | 4/2001 | Smith et al. | |
| 7,538,740 | B2 * | 5/2009 | Korisch et al. | 343/844 |
| 8,185,162 | B2 * | 5/2012 | Haskell et al. | 455/562.1 |
| 8,269,668 | B2 * | 9/2012 | Barker et al. | 342/372 |
| 2003/0189516 | A1 | 10/2003 | Olson | |
| 2010/0227646 | A1 * | 9/2010 | Ogawa et al. | 455/562.1 |

FOREIGN PATENT DOCUMENTS

| | | | |
|---|---|---|---|
| EP | 1353405 | A1 | 10/2003 |
| WO | WO00/31824 | | 6/2000 |
| WO | WO00/39894 | | 7/2000 |
| WO | WO03083992 | A1 | 10/2003 |
| WO | WO2004/051796 | A1 | 6/2004 |
| WO | WO2004/100315 | A1 | 11/2004 |
| WO | WO2008/060206 | A1 | 5/2008 |

OTHER PUBLICATIONS

First partial search report, Corresponding PCT Application No. PCT/EP2010/007168 (Mar. 22, 2011).

* cited by examiner

*Primary Examiner* — Tan Ho
(74) *Attorney, Agent, or Firm* — Nixon & Vanderhye P.C.

(57) ABSTRACT

An improved antenna array has at least one first radiator device and at least one second radiator device and at least one third radiator device. The at least one first radiator device and the at least one second radiator device and the at least one third radiator device are arranged consecutively. The at least one dual-polarized radiator device radiates in both polarization planes (P1, P2). The at least one first radiator device radiates only in one polarization plane (P1 or P2). The at least one third radiator device radiates in one polarization plane (P2 or P1), which is aligned perpendicular to the polarization plane (P1 or P2) in which the at least one first radiator device radiates.

14 Claims, 11 Drawing Sheets

DUAL-POLARIZED GROUP ANTENNA

FIELD

The technology herein relates to a dual-polarised group antenna, in particular a mobile communications antenna.

BACKGROUND AND SUMMARY

For mobile communications antennae, one-column or multi-column antenna arrays are generally used, and conventionally comprise in each column a plurality of radiators or radiator devices arranged above one another in the vertical direction. In this context, dipole radiators, such as are known from WO 00/39894 A1 or WO 2004/100315 A1, may be used, for example in the form of dipole crosses, dipole squares or what are known as vector dipoles. However other radiators and radiator shapes, for example patch radiators, are also possible.

The antenna arrangement may be a single-band, a dual-band, or preferably a multi-band antenna arrangement which preferably transmits and receives in two mutually perpendicular polarisation planes, rather than just in one polarisation plane. These polarisation planes are preferably aligned in the manner of what is known as an X polarisation, meaning that the two mutually perpendicular polarisation planes are aligned at a +45° and a −45° angle to the horizontal (or vertical).

A dual-polarised group antenna of this type according to the prior art should conventionally be able to generate two radiated field patterns which correspond or can be correspondingly controlled, namely a radiated field pattern for each of the two linear polarisations i.e. for both of the mutually perpendicular polarisation planes. These should be electrically independent of one another. Thus, on the one hand the cross polarisation distance of the radiation must be very large. On the other hand, the coupling between the antenna terminals should be very low, i.e. the decoupling (isolation) should be very high.

This is true for every frequency band as a matter of basic principle. Thus, all specifications should be met for the entire frequency range (frequency band). This also applies in the case of a dual-band or even multi-band group antenna, since more and more frequency ranges are currently being allocated to mobile communications. Meanwhile, a mobile communications antenna should cover a frequency range of for example 1710 MHz to 2690 MHz. This corresponds to a bandwidth of 980 MHz or a relative bandwidth of 45% based on the mean frequency. This makes it more difficult and demanding to meet all of the requirements over such a large frequency range. A further complicating factor is that a second, disjoint frequency band of for example 806 MHz to 960 MHz may also be set, and that some of the radiators and radiator devices are then formed or must then be formed as dual-band radiators, as explained above. This increases the total number of radiators and radiator elements between which interactions can take place.

Lastly, a group antenna may also further comprise a plurality of adjacent columns, in such a way that for radiators which are arranged in two different antenna columns, not only the decoupling between two mutually perpendicular polarisation planes in relation to the radiators or radiator devices of an antenna column, but also the decoupling between identical polarisations must be taken into account.

Against this background, there is a need for a group antenna in particular with better decoupling between the two polarisations. This applies for example both to a single-column dual-polarised antenna and to a multi-column antenna.

Thus, WO 00/31824 A1 has already proposed a group antenna which comprises spatially separated groups of single-polarised radiators for each polarisation. However, this results in an extremely high space requirement, in such a way that in practice, systems of this type cannot be implemented.

WO 2004/051796 A1 proposes a two-dimensional array of group antennae, a respective radiator arrangement being provided in each of the at least two vertically extending columns and these arrangements being powered separately from one another. In this case, at least one radiator or radiator device is provided for example in the second column and is powered together with the radiators or radiator arrangements in the first antenna column. Conversely, at least one radiator or radiator device is provided in the first antenna column and is powered together with the radiators in the second antenna column. Ultimately, this does serve the beam-forming process, but not in such a way as to allow an improvement in the decoupling to be achieved.

WO 2008/060206 A1 also proposes an antenna array with dual-polarised radiators, which in each case comprise at the edges a region with single-polarised radiators with the same polarisation. In this case, the number of radiators which are interconnected in a group varies. This too should produce a different radiated field pattern. In other embodiments, a two-column antenna is proposed, in which for example in one column, radiators are aligned only in one polarisation direction, and in the second column, the radiators are aligned only in a polarisation plane perpendicular thereto, the distance between the radiators with the same polarisation plane being different in the two antenna columns. As stated, these measures all serve to produce different radiated field patterns.

Against this background, the present invention is based on prior art which is basically shown in FIG. 10.

For this purpose, a category-defining antenna array according to FIG. 10 comprises for example a plurality of radiator devices 3, which are formed as dual-polarised radiator devices and for this purpose comprise radiators or radiator elements 3*a* which are powered, and thus transmit and/or receive, in a first polarisation plane and second radiators or radiator elements 3*b* which receive and/or radiate, in a second polarisation plane P2 perpendicular to the first polarisation plane P1. Preferably, the two polarisation planes are at a plane angle of ±45° to the vertical or horizontal.

The aforementioned radiator devices shown in FIG. 10 are thus arranged adjacent to one another in the installation direction 5 (a linear arrangement), above one another in the embodiment shown. In this respect, it is also possible to speak of a single-column group antenna, i.e. a group antenna with an antenna column 7, which is conventionally aligned in the vertical direction or predominantly in the vertical direction, but may in principle also be aligned in the horizontal direction and in any other desired direction with a vertical and a horizontal component. For simplicity, in this respect the following will always refer to an antenna column independently of the alignment thereof.

The aforementioned radiator devices 3 are thus conventionally arranged in front of a reflector 1. The dual-polarised radiators may for example be radiator devices in the form of a dipole, for example dipole crosses, dipole squares, vector dipoles etc., such as are known from the aforementioned document WO 00/39894 A1. Patch radiators and other radiators devices are also possible. There are no limitations in this respect.

The radiators 3*a* for one polarisation plane P1 are powered via a network N1, whereas the radiators 3*b* which transmit in the second polarisation plane P2 are powered via the network N2.

Based on the prior art, the object of the present invention is now to provide an improved antenna array, which can in principle be single-column or multi-column, and which can be operated in one band or preferably also in a plurality of bands, it being possible by simple means to achieve better decoupling between the polarisations of dual-polarised radiators in one column and/or better decoupling for radiator devices with the same polarisation plane in adjacent columns.

The object is achieved according to the invention by the features specified in claim 1. Advantageous embodiments of the invention are specified in the subclaims.

The solution according to the invention is distinguished in that a dual-polarised group antenna comprises three different regions or three different types of radiator arrangement or ways of powering the radiator arrangements, it being provided that at least one and preferably a plurality of radiator devices are powered in both of the mutually perpendicular polarisation planes, and in that each antenna column is allocated at least one further additional radiator device, which is powered either only in the first polarisation plane or only in the second polarisation plane. The additional radiator arrangements may be single-polarised radiators or alternatively dual-polarised radiators, which unlike the other radiators are powered only in one polarisation plane.

In this case, the total number of radiators in group antenna which are powered with the first and the second polarisation is equal.

Conventionally, dual-polarised antennae are constructed to be as similar as possible, to obtain similar radiated field patterns in both polarisation planes. Thus, the best decoupling would also be expected with a symmetrical construction. This makes it all the more surprising that the invention achieves an improvement by means of an asymmetrical configuration of the antenna array, since in the context of the invention the arrangement of the radiators and/or the operation of the radiators are no longer necessarily similar or symmetric. This is because the configurations and/or positions are different for the active radiators or radiator devices in the groups of radiator devices allocated to both polarisations. The two polarisations of a dual-polarised radiator are used in parallel in part (as was also previously the case), whereas now, according to the invention, other further single- or dual-polarised radiators spatially separated from one another are provided, but in the case of the dual-polarised radiator are only operated in one polarisation plane. This construction, which is slightly more complex in itself, nevertheless ultimately leads to a partial spatial separation of the two polarisation planes, and thus surprisingly contributes to the improved decoupling. The improvement in the decoupling in this case may be so great that the entirety of all the other specifications or radiation diagrams, adjustments and the desired bandwidth requirements can be met.

Two dual-polarised antennae with similar or identical frequency ranges can also be arranged behind one another along a single column. In the context of the present invention, a dual-polarised radiator can be used in the centre for example of the of the +45° polarisation of the first antenna and simultaneously of the −45° polarisation of the second antenna. Single-polarised radiator devices, which radiate either in one polarisation plane or in the other polarisation plane, can be arranged above and below.

If two antenna columns are arranged adjacent to one another, then there can be additional dual-polarised radiators, of which one polarisation plane is allocated to one column and the other polarisation plane is allocated to the second antenna column, i.e. to the radiators or radiator devices powered in one or other antenna column respectively.

BRIEF DESCRIPTION OF THE DRAWINGS

The invention is described in greater detail below by way of drawings, in which, in detail.

DETAILED DESCRIPTION

Figure 10:
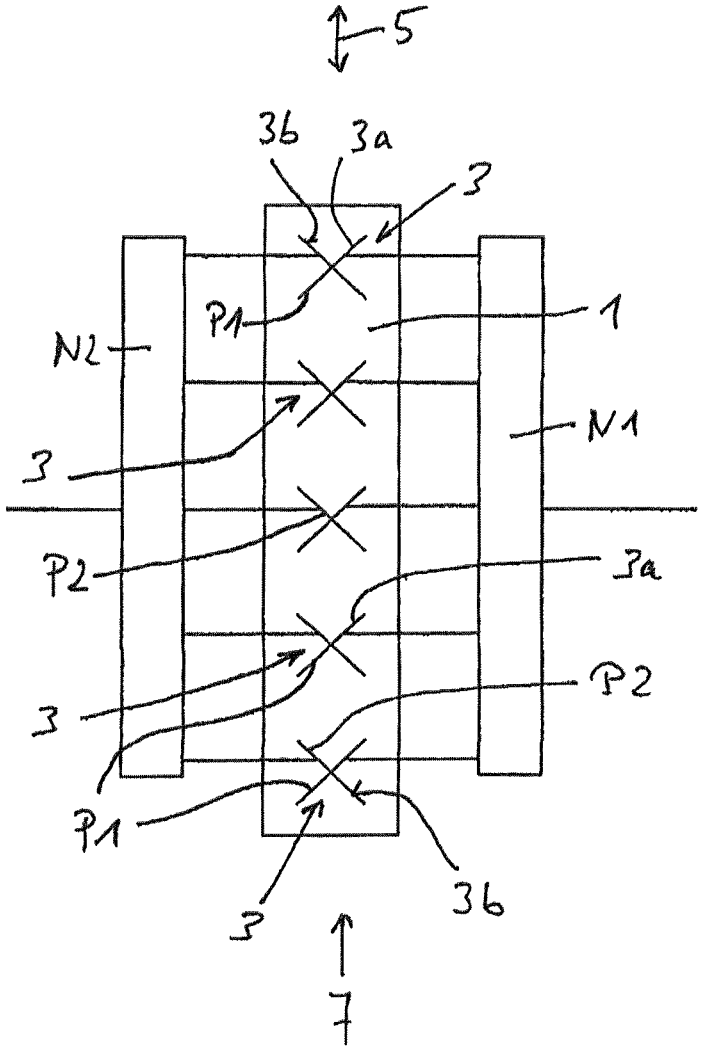
Fig. 10 (PRIOR ART)
FIG. 10 shows an antenna array of the type known from the prior art.

In the following, a first embodiment of the invention is described in greater detail in relation to FIG. 1. Identical or similar elements are denoted by the same reference numerals as in the explanation of the group antenna known from the prior art according to FIG. 10.

Figure 1:
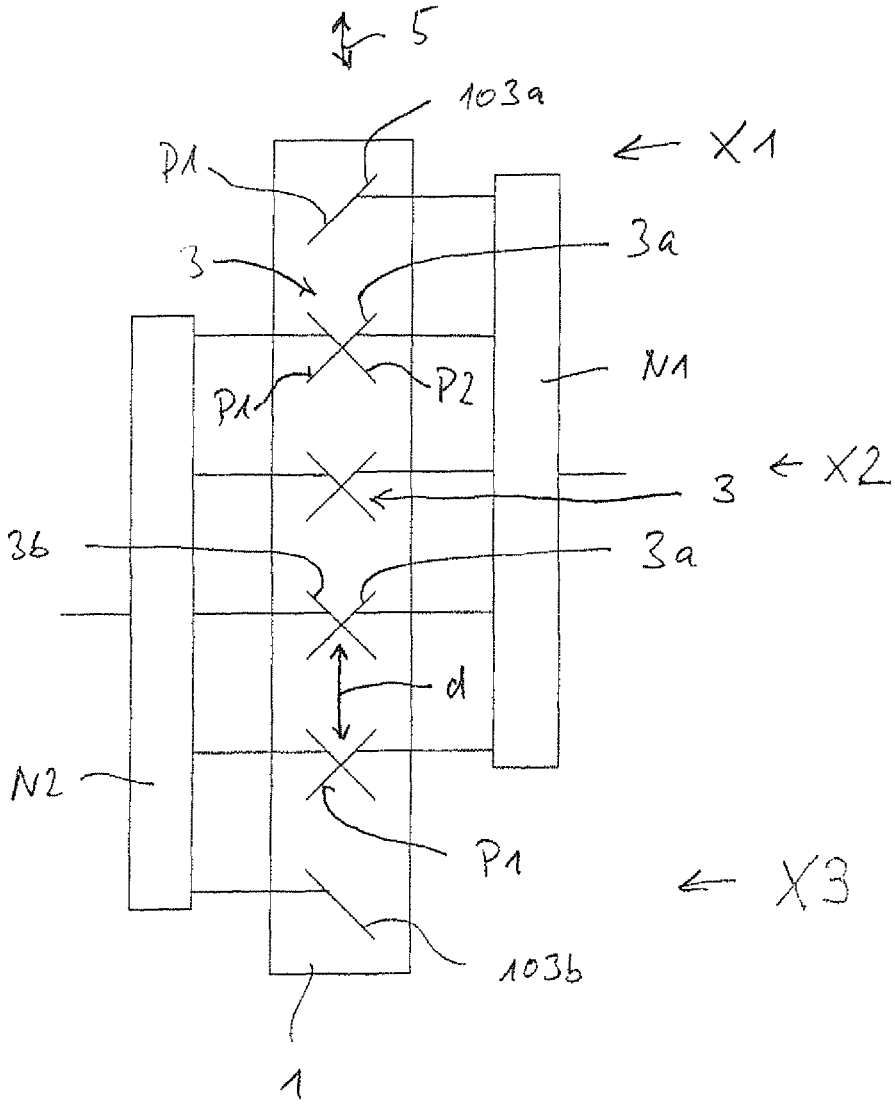
FIG. 1 shows a schematic first embodiment according to the invention, comprising four dual-polarised radiators in an antenna column, which are powered in both polarisations, and an upper single-polarised radiator and a single-polarised lower radiator, which radiate in two mutually perpendicular polarisation planes.

In other words, the embodiment according to the invention in FIG. 1 has a reflector 1, in front of which in the installation direction 5 radiator devices 3 are provided at a distance from one another in the vertical direction—at equal distances in the embodiment shown—the radiator elements 3*a* of said devices radiating, i.e. transmitting or receiving, in the polarisation plane P1 and the radiator elements 3*b* thereof radiating in the polarisation plane P2, the two polarisation planes being mutually perpendicular and being aligned (at least approximately aligned) at a ±45° angle to the vertical or horizontal.

In this case, the elements radiating in one polarisation plane P1 are powered via a network N1, whilst the radiator elements 3*b* operated in the second polarisation plane P2 are powered via the network N2. The embodiment shown is a monoband antenna.

In the same embodiment, it is now provided that an uppermost radiator device 103*a* is provided adjacent to the four central radiator devices 3 (which are operated and powered in both polarisation planes) and is also powered via the first network N1 together with the other radiators 3*a* of the same polarisation plane P1, and that a lowermost radiator device 103*b* is provided in association with the antenna array and is powered via the second network N2 together with the other radiators 3*b* operated in the second polarisation plane P2.

This arrangement means that now n radiators or radiator elements or devices 3, five radiators or radiator elements in the embodiment shown, are provided for each polarisation plane, the central four radiators being operated in the two mutually perpendicular polarisation planes and the uppermost radiator device being powered via the right network N1 and the lowermost radiator device 103*b* (which is aligned perpendicular to the uppermost radiator device 103*a*) is powered via the left network N2. In other words, this results in n+1 radiator devices 103*a*, 3, 103*b* arranged above one another, i.e. in this example six radiator devices arranged above one another, specifically five active radiator devices for each polarisation P1, P2. In other words, in this embodiment n radiators, for example dipole radiators, are provided in a polarisation direction P1 or P2, the height offset by the difference d between the radiators which radiate in one linear polarisation plane P1 and the radiators which radiate in the other polarisation plane P2, resulting in a total of n+1 radiator positions, specifically four dual-polarised radiators and an upper and a lower radiator which are each single-polarised.

This therefore results in at least three antenna regions for the antenna according to the invention, specifically a central region X2 with dual-polarised radiators 3 and an upper and a lower further radiator region X1 and X3 (each at the ends of the antenna arrangement adjacent to the central radiator region X2), in which at least one radiator arrangement 103*a* or 103*b* is arranged for said antenna or antenna group in each case and radiates in only one or only the other polarisation plane.

In this context, reference will also occasionally be made in the following to at least one first radiator device 103*a*, at least one second radiator device 3 and at least one third radiator device 103*b*, the at least one first radiator device 103*a* being arranged in the aforementioned one or first radiator region X1, the at least one second radiator device 3 being arranged in the aforementioned second radiator region X2 and the at least one third radiator device 103*b* being arranged in the aforementioned third radiator region X3. In other words, at least a second radiator device 3 is arranged in the central region X2 between the two mutually offset first and third regions X1, X3, one region X1 being provided higher and the third region X3 being provided lower in an at least substantially vertically aligned mobile communications antenna.

The offset in each case of the radiator devices which are arranged successively in the installation direction or are arranged above one another may in this case be equal over the whole of the group antenna, i.e. also correspond to the distance d between the uppermost radiator element 103*a* and the adjacent dual-polarised radiator element 3 and between the lowermost radiator element 103*b* (i.e. the respective centre of this radiator device 103*b*) and the dual-polarised radiator device 3 located above. However, the distances may also be configured so as to differ from one another, and therefore need not necessarily be the same.

At this point, it should already be noted that it is not necessary for all of the dual- or single-polarised radiators 3, 103*a*, 103*b* to be arranged precisely in a line in the construction direction 5. It is also quite possible for one radiator or the other instead to be offset transverse to the installation line or for example to be positioned instead in an adjacent antenna column. However, this also alters the radiated field pattern, and to do so is not the primary aim of the present invention.

Figure 2:
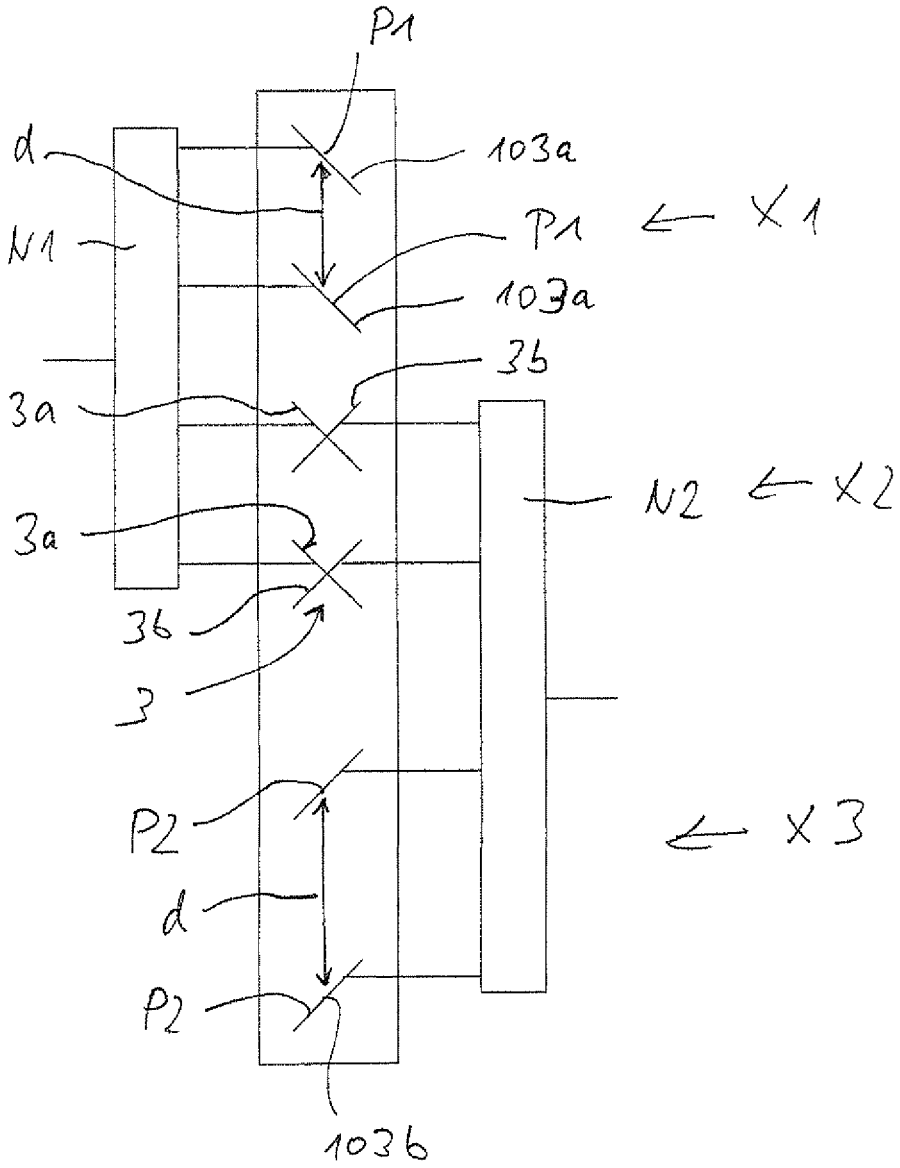
FIG. 2 shows an embodiment modified from FIG. 1, in which two pairs of single-polarised radiators are provided in each case and radiate in opposite polarisation planes, and two dual-polarised radiator devices are provided between them.

In the embodiment of FIG. 2, it is now provided for only the two central dual-polarised radiator devices 3 to be operated in both polarisation planes, whilst now two uppermost single-polarised radiator devices 103*a* radiating in one polarisation plane P1 and two lowermost single-polarised radiator devices 103*b* are provided, and each of the two is operated in the second polarisation plane B2.

In this case, n single-polarised radiator devices, i.e. four in the embodiment shown, are provided for each polarisation, in such a way as to result in a total of n+2, i.e. six radiator devices 103*b*, 3, 103*a* arranged above one another, four of these each being operated in a single-polarised and two in a dual-polarised manner, in each case via the corresponding network N1, N2.

Thus, two first radiator devices 103*a*, two second radiator devices 3 and two third radiator devices 103*b* are provided in this embodiment.

For this embodiment, it is further illustrated that the distances d between the positions (centres) of the two central dual-polarised radiator devices and between the mutually adjacently arranged single-polarised radiator devices 103*b* located above them in each case are equal and are also smaller than the distance d between the positions of the lowermost dual-polarised radiator device 3 and the respective downwardly adjacent single-polarised radiator element 103*b* or between the two end single-polarised radiator elements 103*b*.

In general, the arrangement is therefore arranged in such a way that with n radiator elements for each polarisation 1, 2, etc., a maximum of n−1 can be formed as single-polarised radiators, in such a way that ultimately m=n−1, m=n−2, etc. to a minimum of m=1 radiator arrangements is or are formed as dual-polarised radiator arrangements, which are simultaneously operated in two mutually perpendicular polarisation planes.

Figure 3:
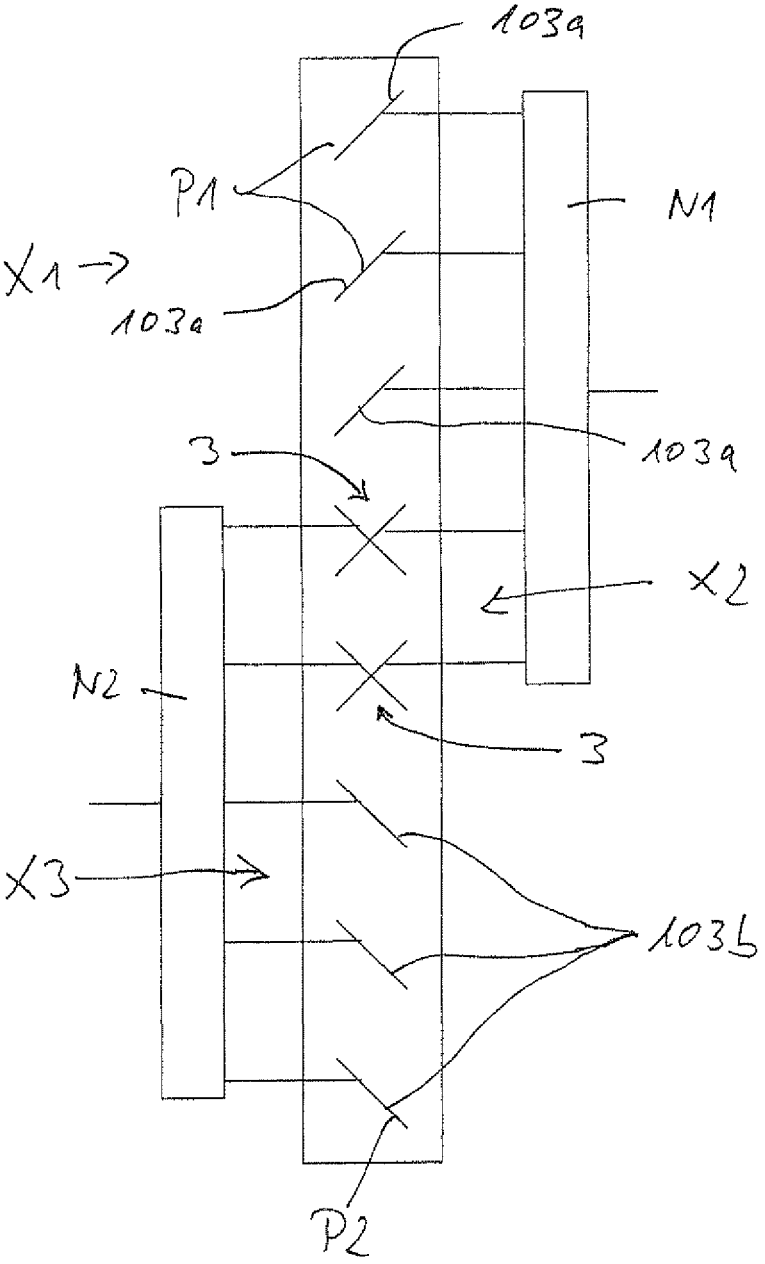
FIG. 3 shows an embodiment modified from FIGS. 1 and 2, comprising a plurality of radiator devices which are each single-polarised.

In the embodiment of FIG. 3, the solution explained above has been developed even further, five radiator devices being provided for each polarisation in this example. The three uppermost first radiator devices 103*a* in the upper region X1 radiate in one polarisation plane P1, whilst the three lowermost third radiator devices 103*b* in the region X3 radiate in the polarisation plane P2 aligned perpendicular thereto. Only the two second radiator devices 3 in the central region X2 are formed as dual-polarised radiator devices.

It is irrelevant for the advantages achieved according to the invention whether the uppermost single-polarised radiators radiate in the polarisation plane P1 and the lowermost single-polarised radiators radiate in the polarisation plane P2 or vice-versa.

Thus, in this embodiment too, n radiators, i.e. five in the embodiment shown, are provided for each polarisation plane, m of these radiators being formed as dual-polarised radiators, specifically the two central radiators, in such a way that in this embodiment m is equal to the number 2. Therefore, n−m single-polarised radiators 103*a* and 103*b* are provided. In this embodiment too, the number m can be a minimum of 1 so at least one dual-polarised radiator is provided in the centre. If, by contrast with FIG. 3, m=3 or m=4, then three or four dual-polarised radiators (in the centre of the antenna array) are provided above one another in such a way that in this case, where n−m=5−3=2, only two upper and two lower linear-polarised radiators are provided or in the other case, where n−m=5−4=1, only one upper and one lower, differently polarised, single-polarised radiator 103*a* and 103*b* are provided, it being necessary in all these embodiments for n and m to be natural numbers and for n to be at least three or more, so as to form three different antenna regions X1, X2 and X3, specifically an antenna region X2 comprising at least one dual-polarised radiator and at least two regions X1 and X3 each comprising at least one single-polarised radiator, one in one polarisation alignment and one in the polarisation alignment perpendicular thereto. In all of these cases, m may have a value of 1, 2, etc. up to a maximum of n−1.

Figure 3C:
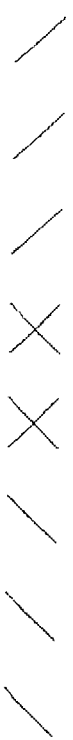
FIGS. 3*a* to 3*c* are three diagrams to illustrate how an antenna arrangement according to the invention, which comprises radiator devices which radiate in one polarisation plane and in a second polarisation plane perpendicular thereto, is constructed.
Figure 3B:
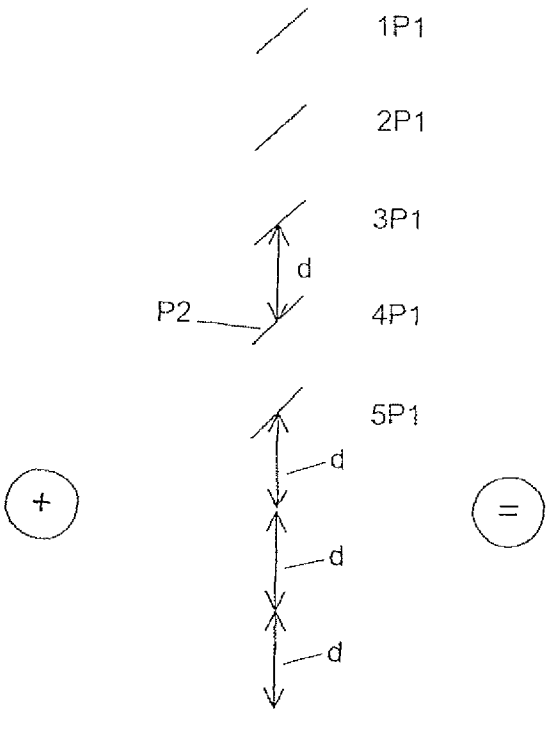
Figure 3A:
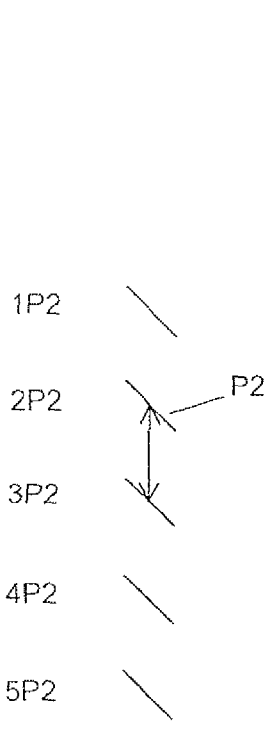

FIGS. 3*a* and 3*c* further show schematically how the antenna constructed according to the invention is fundamentally formed. FIG. 3*a* shows that for example five radiator arrangements, which each radiate in the polarisation plane P2, are arranged above one another at a positional distance d, in such a way that the five radiators radiating in the polarisation plane P2 are positioned in the positions 1P2, 2P2, 3P2, 4P2 and 5P2.

In FIG. 3*b*, five radiator elements are arranged above one another at the same positional distance b and radiate in the polarisation plane P1 perpendicular thereto. These five radiator elements are thus arranged in the positions 1P1, 2P1, 3P1, 4P1 and 5P1. The radiator elements shown in FIG. 3*a* radiating in the polarisation plane P1 are thus shown offset upwards by a triple offset of 3×d from the radiator elements shown on the left in FIG. 3*a* radiating in the second polarisation plane P2. In accordance with FIG. 3*c*, this has the result (when the radiator elements in the first polarisation plane P1 and in the second polarisation plane P2 are arranged together above one another in a vertical arrangement) that the radiators arranged in the positions 1P2 and 2P2 and radiating in the second polarisation plane P2 are combined with the radiators arranged in the fourth and fifth positions 4P1 and 5P1 and radiating in the first polarisation plane P1 to form dual-polarised radiators, and in accordance with the outcome in FIG. 3*c* the first radiator devices 103*a* radiating or operating in the first polarisation plane P1 are formed uppermost, below which are formed the two second radiator devices 3 which are formed as dual-polarised radiators 3, below which are formed three third radiator devices 103*b* which radiate in the second polarisation plane P2.

Generally speaking, it can be said that the radiators for the first polarisation plane, which is powered by one network N1, and the radiators which radiate in the other polarisation plane and are powered via the second network N2, are arranged mutually offset by one or more distances d, i.e. arranged mutually offset in the installation direction 5, the distance d corresponding to the distance between two adjacent radiator devices. This results in an overall solution in which each radiator element radiating in one polarisation plane P1 and powered via one network is combined with a radiator element arranged in a relatively higher or lower position, radiating in the second polarisation plane P2 and powered via the second network, to form a combined dual-polarised radiator element. The offset in the installation direction of the radiator elements in one polarisation plane and the other means that upper and lower first radiator devices 103*a* and third radiator devices 103*b* are formed, i.e. generally offset in the installation direction, of which the first radiator devices 103*a* only radiate or are operated in one polarisation plane P1 or P2 and the third radiator devices 103*b* only radiate or are operated in the respective perpendicular polarisation plane P2 or P1.

Figure 4:
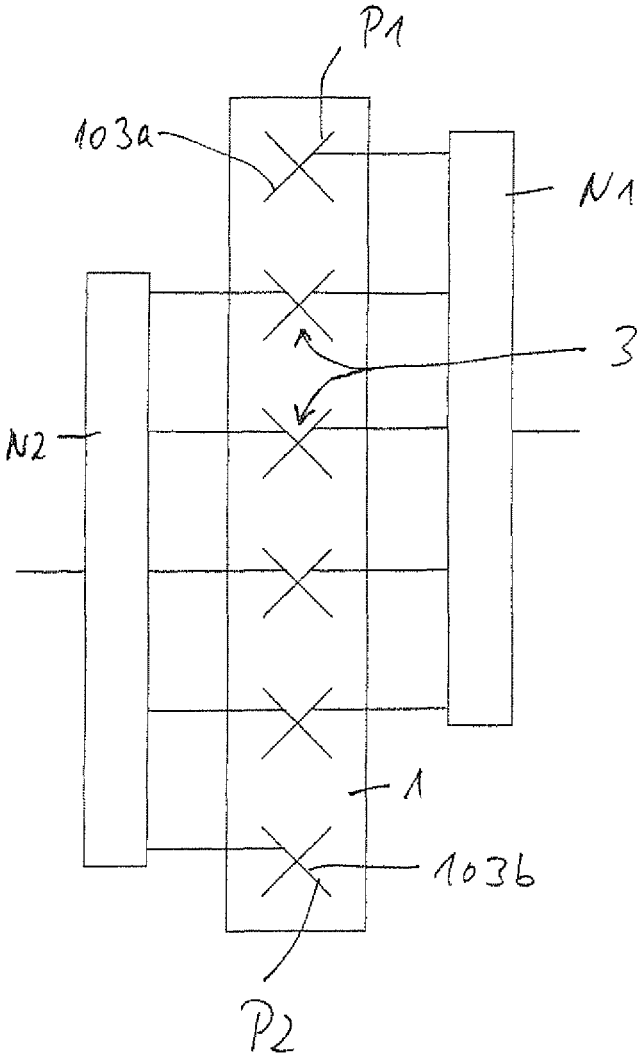
FIG. 4 shows an embodiment modified from FIG. 1, which only comprises dual-polarised radiator devices, but in which the uppermost and the lowermost dual-polarised radiator devices are each operated in only one polarisation plane.

FIG. 4 now illustrates an embodiment similar to that of FIG. 1. The only difference in this embodiment is that by contrast with FIG. 1, a dual-polarised first and third radiator 3 is arranged in each of the uppermost and the lowermost position (region X1 and region X3), it being possible but not necessary for said dual-polarised first and third radiators to correspond to the other dual-polarised radiators 3 in construction and configuration. However, the dual-polarised first radiator arranged uppermost is powered only in one polarisation plane P1, and thus has the same effect as a single-polarised radiator 103*a* in FIG. 1.

The dual-polarised third radiator 3 arranged lowest in the region X3 is only powered in the second polarisation plane P2 perpendicular thereto, and thus only has the same function in electrotechnical terms as the single-polarised radiator 103*a* in FIG. 1.

In this embodiment, n thus has a value of 5, since for each polarisation plane five radiator devices are provided, the value for m being 4, since four dual-polarised radiators are provided in the centre and only one upper and one lower radiator, which is in fact formed as a dual-polarised radiator but only radiates in one polarisation plane. As stated, in this case the circuit of the dual-polarised radiators may be different, i.e. they may be formed for example as a dipole cross, as a dipole square, as a vector dipole or as a patch radiator. Therefore, the radiator types need not necessarily be identical.

As in all the embodiments above, and indeed below, to achieve a sufficiently similar configuration of the radiated field pattern, the number of radiators 103*a* powered only in one polarisation plane P1 is identical to the number of radiators 103*b* powered in the other polarisation plane P2. Thus, in the embodiments shown, the dual-polarised radiator devices 3 which are powered in both polarisation planes are provided in the central region of the antenna array between the radiators 103*a*, 103*b* formed as single-polarised radiators or the dual-polarised radiators 103*a*, 103*b* which are operated only in one polarisation plane (i.e. between the uppermost and lowermost positions of the antenna array).

Thus, quite generally, the radiators which are aligned in a respective polarisation plane P1 or P2, or which are dual-polarised and radiate in this one polarisation plane, are arranged in the upper and lower antenna positions offset from the centre of the antenna array, in such a way that the radiators or radiator arrangements radiating in both polarisation planes are provided in the central positions of the antenna array.

Figure 5:
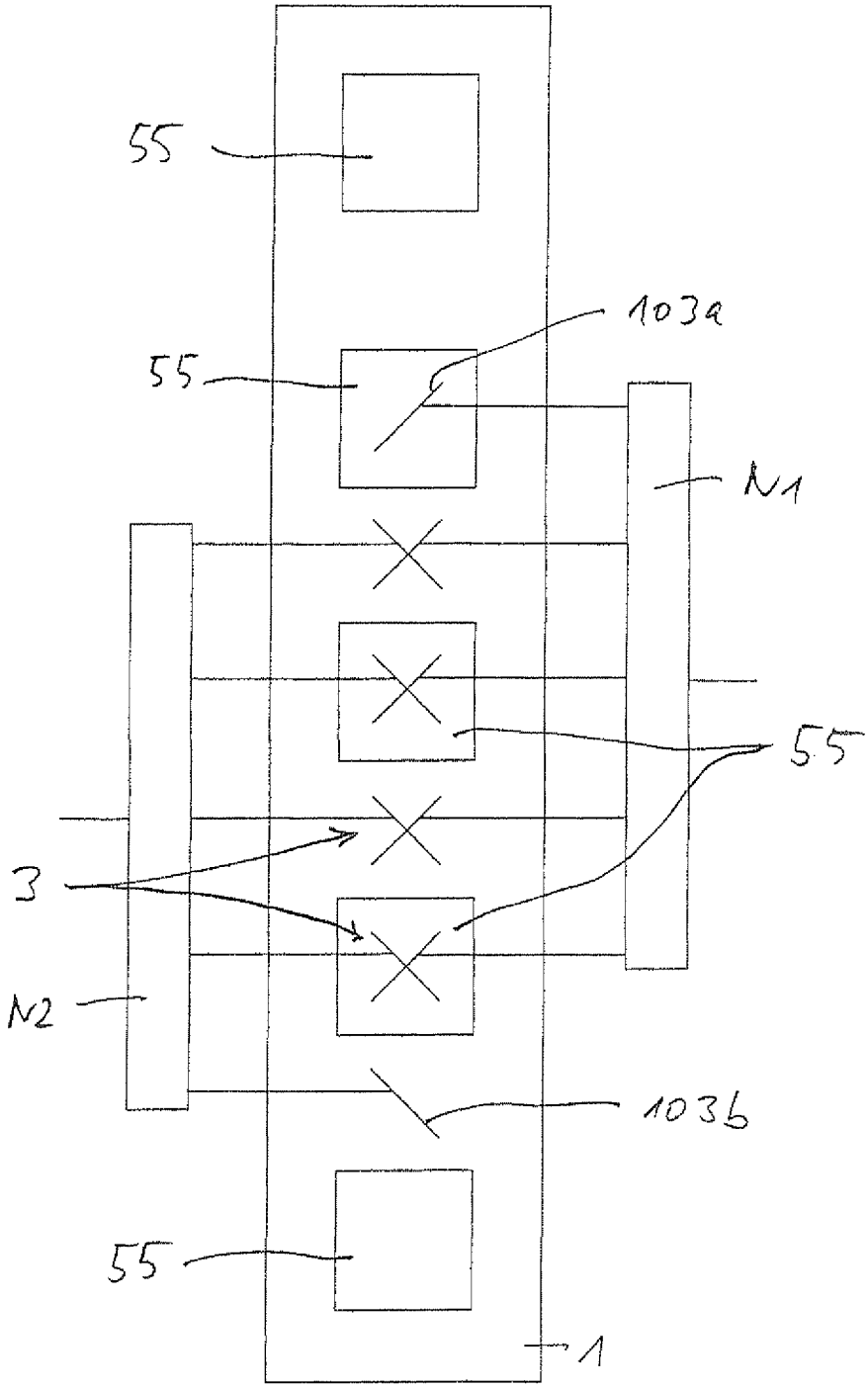
FIG. 5 shows a further schematic embodiment according to the invention of a group antenna which is operated in two frequency bands.

FIG. 5 discloses a variant which comprises a group antenna with an antenna construction corresponding to FIG. 1. However, the group antenna illustrated by FIG. 5 is now formed as a dual-band group antenna, the antenna system with the radiator devices 55 for the lower frequency band $F_n$ being shown in a square shape. The antenna system for the higher frequency band $F_h$ is thus arranged inside the dual-polarised group antenna formed as a dual-band antenna, the radiator means shown as cross-shaped, for example in the form of dipole crosses or dipole squares, representing the corresponding dual-polarised radiators of the higher frequency band $F_h$ and the radiator devices 103*a*, 103*b* shown as lines representing the merely single-polarised radiators of this high frequency band $F_h$ (in correspondence with the embodiment of FIG. 1).

The associated networks N for powering the single- or dual-polarised radiator devices 55 for the lower frequency band $F_n$ have not been shown in FIG. 5 and have been omitted, for the sake of simplicity and clarity.

In this embodiment too, dual-polarised radiators can be used instead of the single-polarised radiators 103*a*, 103*b*, but operated only in one of the two respective polarisation planes, as was explained in reference to FIG. 4. Equally, a plurality of upper and a plurality of lower single-polarised radiators or dual-polarised radiators which are only operated in one polarisation plane may be provided, as is explained with reference to FIG. 2 and FIG. 3.

Figure 6:
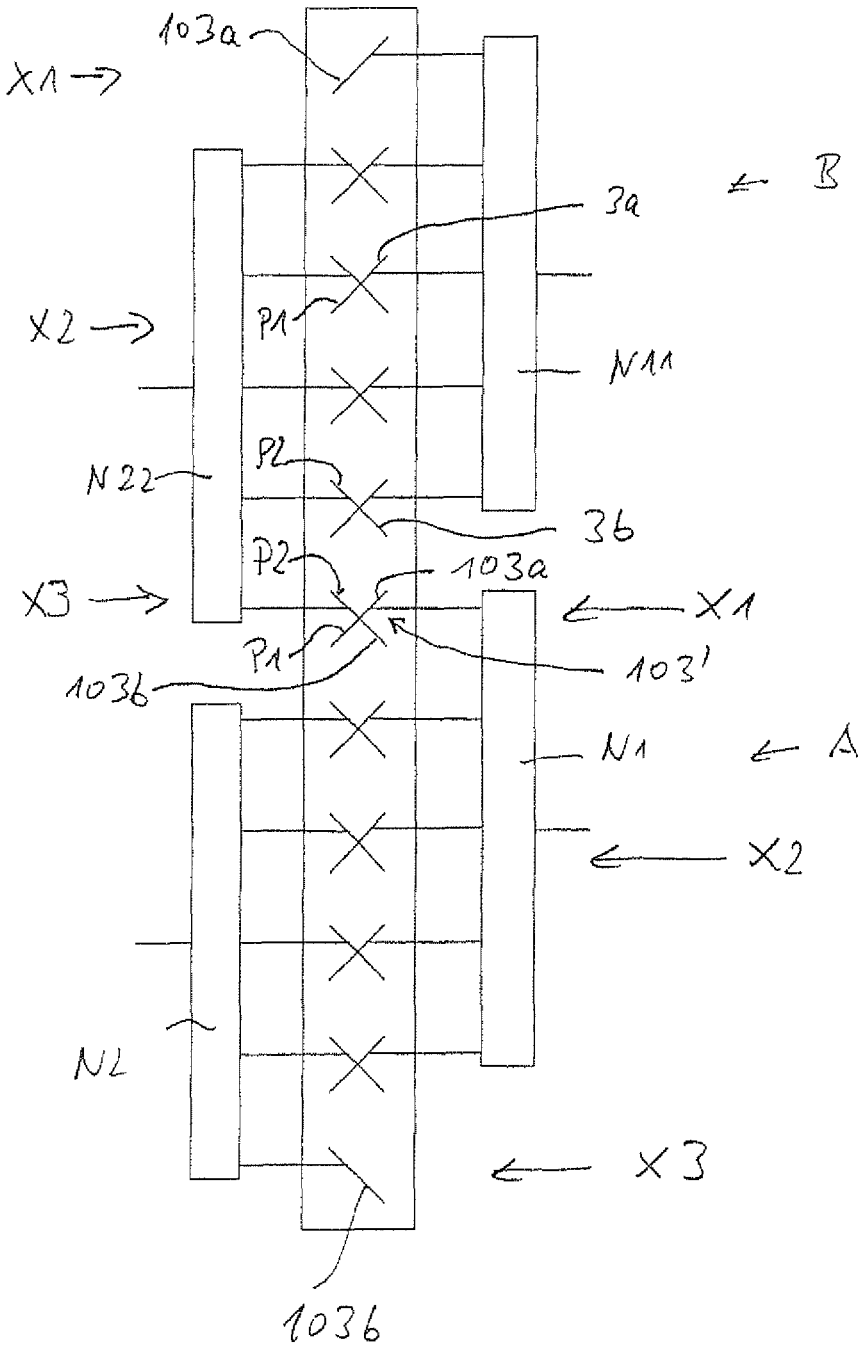
FIG. 6 is a schematic view of a further embodiment according to the invention comprising two dual-polarised groups of radiator devices, which are arranged above one another along an installation direction (line), the radiator device positioned in the centre of the group antenna being used in relation to the polarisation of the lower group of radiator devices, whilst the polarisation perpendicular thereto of the central radiator device is used by the second groups of radiator devices.

In the embodiment of FIG. 6, two dual-polarised groups of antennae are now arranged in the installation direction 5, i.e. vertically above one another, a first group A basically being formed with the two networks N1 and N2, as is shown in the embodiment of FIG. 1.

The second group B with corresponding radiators and radiator devices is also constructed equivalently, the radiators or radiator elements 3*a* which radiate in the polarisation plane P1 being powered via the network N11 and the radiators or radiator elements 3*b* which radiate in the second polarisation plane P2 being powered via the second network N22.

Thus, the arrangement is now such that the radiator device 3 in the centre of the whole group antenna is powered for one polarisation plane P1 via the lower antenna group A and the second polarisation plane P2 perpendicular thereto is powered via the network N22 of the upper antenna group B. In other words, in this case the single-polarised first antenna element 103*a* at the top of FIG. 1 in the first region X1 is effectively combined with the third antenna element 103*b* polarised perpendicular thereto at the bottom of the lower group in the region X3, to form a dual-polarised antenna element which is powered in both polarisation planes via both groups.

In this embodiment, the three radiator regions X1, X2 and X3 are provided for each of the antenna groups A or B, the antenna region X1 of the lower antenna group A coinciding with the antenna region X3 of the upper antenna group B, in such a way that in this case a dual-polarised radiator 103' can be used and is powered in one polarisation plan P1 via the network N1 of the lower antenna group A and in the other polarisation plane P2 via the network N22 of the upper antenna group B.

In precisely this manner, the example of FIG. 6 could be modified in that the radiators radiating in one polarisation plane P1 and those radiating in the other polarisation plane P2 in both groups are combined not only with an offset d in the vertical direction, but for example with a doubled interval 2*d* or 3*d*, etc., in such a way that at highest and at the lowest point, two or three, etc. single-polarised radiators (or dual-polarised radiators which radiate in only one polarisation plane) are provided in each case, and in such a way that in this case two or three, etc. central dual-polarised radiators are provided of which two, three, etc. are powered by one network N1 of the first antenna group A and these dual-polarised radiators in the centre of the antenna array are powered for the second polarisation plane P2 via the network N2, since the radiator components radiating in the plane belong to the second antenna group B. In other words, in this case too the offset or the number of single-polarised radiators can be varied, as was explained in principle in relation to the embodiments 1 to 5 above.

Figure 7:
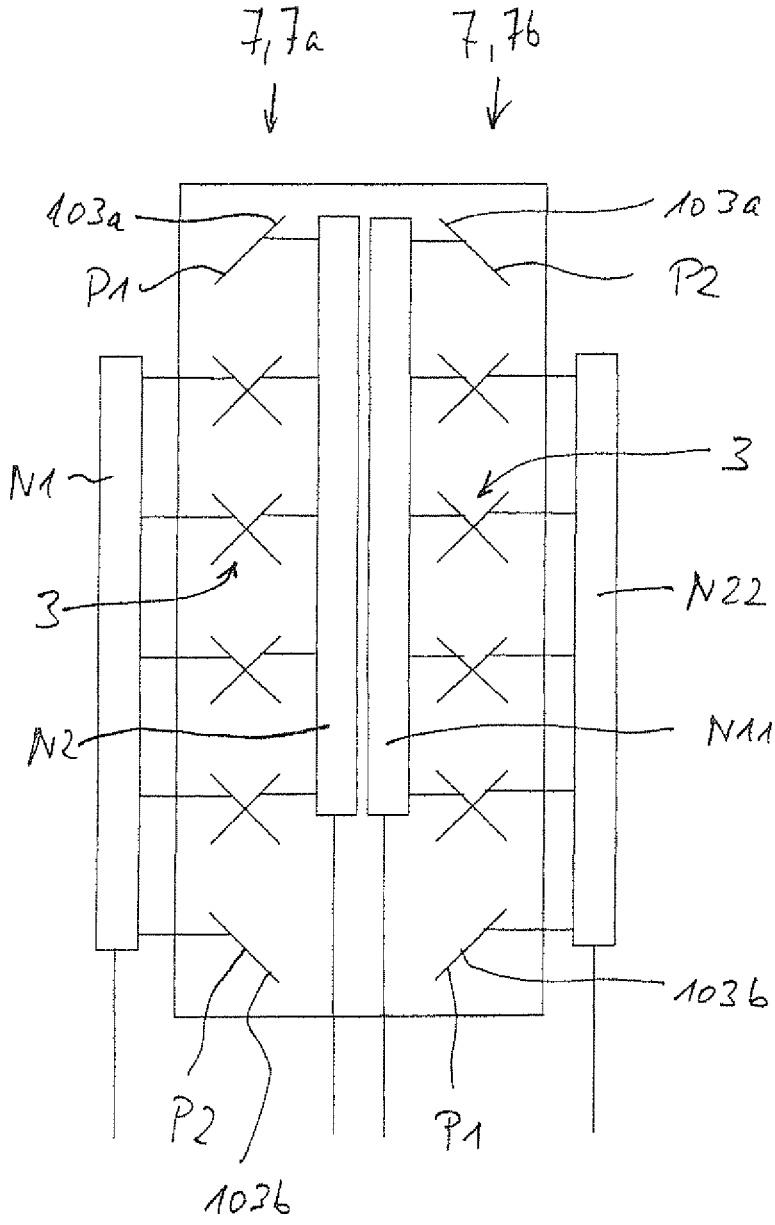
FIG. 7 shows a further embodiment according to the invention of a two-column group antenna.

FIG. 7 shows an embodiment of a two-column antenna array, in which corresponding radiators and radiator devices are positioned in the column 7*a* and in an adjacent, likewise vertical antenna column 7*b* extending parallel to the first antenna column. The radiator device can be formed in either of the two columns in accordance with any one of the previous embodiments or in a similar manner. In the embodiment shown, the arrangement of the radiators in the antenna column 7*a* corresponds to the embodiment of FIG. 1. The same arrangement could also be provided in the second column 7*b*. In the embodiment shown, the arrangement in the column 7*b* is simply a mirror image of the alignment and arrangement of the radiators in the first column 7*a*. Thus in the region X1, in the first antenna column 7*a*, the single-polarised first radiator 103*a* radiates in the first polarisation plane P1, and the third radiator 103*b* arranged lowermost in the third region X2 radiates in the polarisation plane P2 perpendicular thereto, whilst in the second column 7*b*, the single-polarised first radiator 103*a* arranged uppermost in the region X1 radiates in the second polarisation plane P2 and the third radiator 103*b* lowermost in the region X3 radiates in the first polarisation plane P1. Equally, the two columns could also be swapped in the embodiment of FIG. 7. Naturally, in this case too the single-polarised radiators can be replaced with dual-polarising radiators, which are however only operated in the one polarisation plane assigned in each case, as was explained in relation to FIG. 4.

Figure 8:
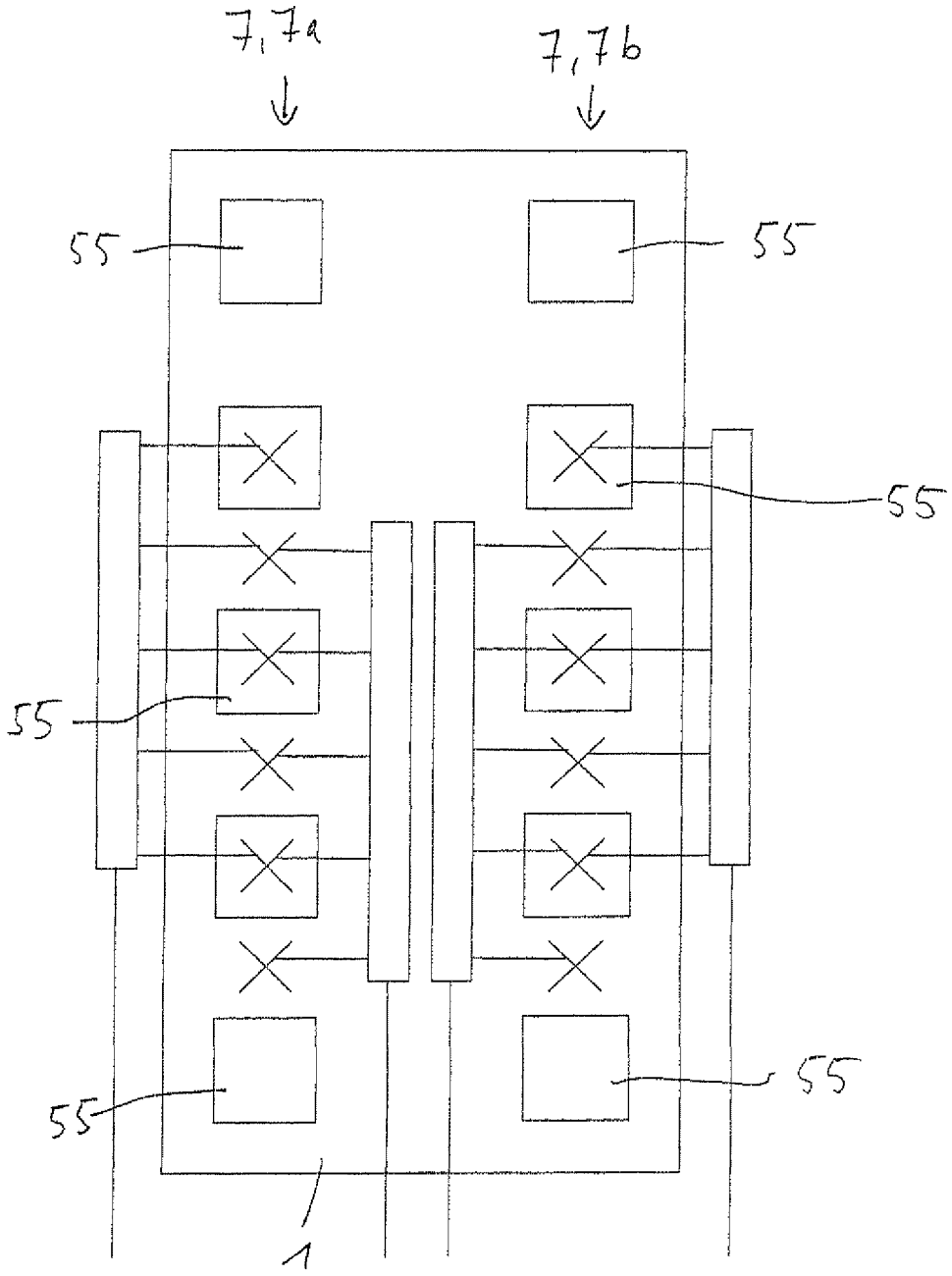
FIG. 8 shows an antenna array comprising two antenna columns with radiator devices which are operated in a lower and a higher frequency range.

The embodiment of FIG. 8 further shows that in a two-column group antenna, the uppermost and lowermost radiators 3, which as stated radiate only in one polarisation plane P1 or P2, can also be used for the higher frequency band $F_h$. It is additionally shown in FIG. 8 for the two-column antenna array that this may be a dual-band antenna again, as was explained for a single-column dual-band antenna in relation to FIG. 5. In this case, the generally dual-polarised radiators for the lower frequency band $F_n$ are shown as rectangles, of which the distance in the installation direction can be approximately twice as great as the distance d between the centres of the dual-polarised radiators for the higher frequency band $F_h$. However, in principle, the distances d may be different and vary to some degree in this case too.

In the embodiments, it was explained that the radiators are offset from one another in the installation direction 5. As explained above, at least some individual radiators, i.e. single-polarised radiators or dual-polarised radiators, at least have just one component offset in the installation direction, with the result that the relevant radiators or radiator devices are not arranged at a distance from one another on a precise, straight installation line, but are also laterally offset therefrom. However, as explained, this leads to an alteration to the radiated field pattern. If this is actually desired, additional measures of this type could be expedient.

Figure 9:
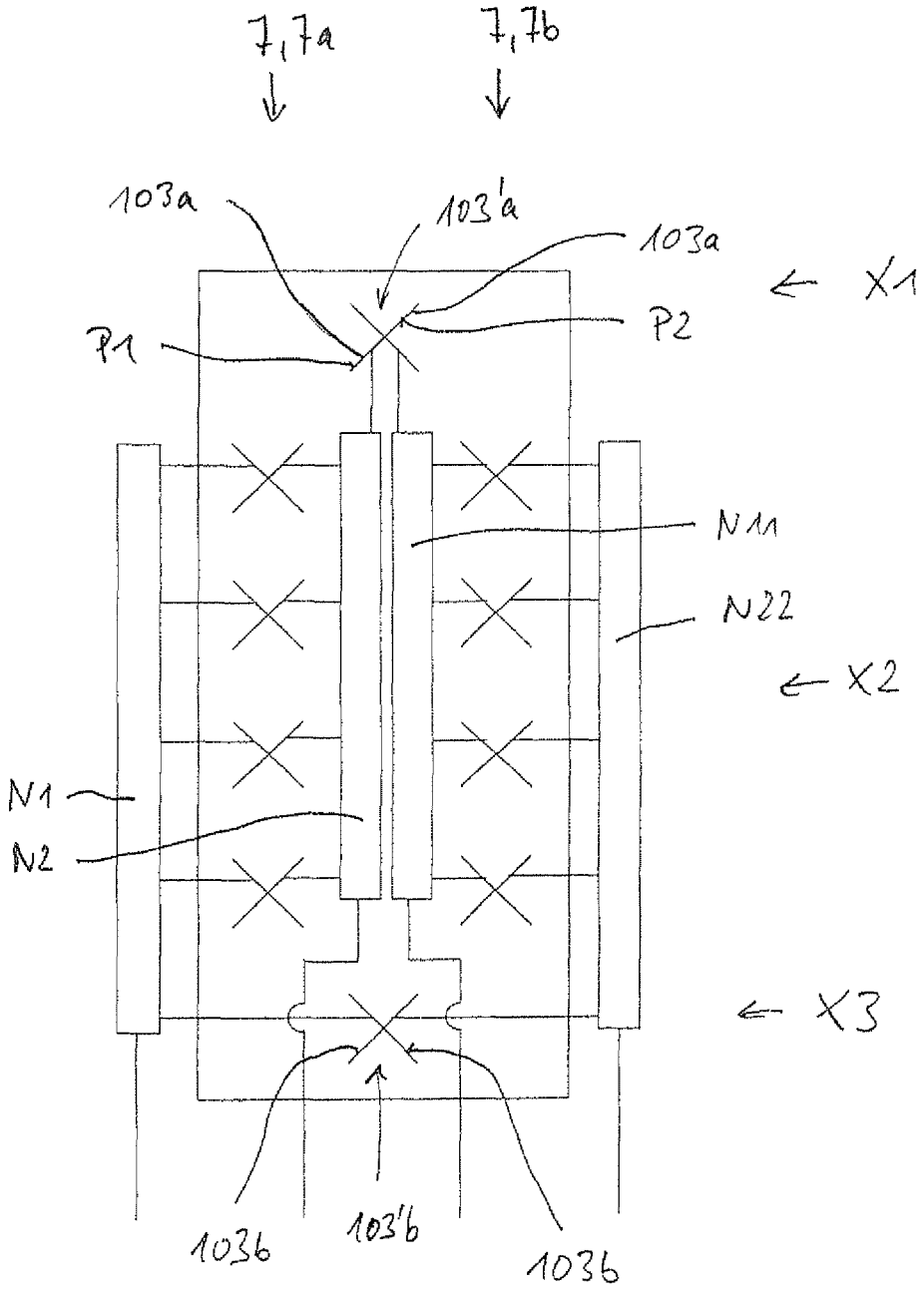
FIG. 9 shows a further modified antenna array comprising two antenna columns with radiator devices, at least a combined upper and at least a combined lower dual-polarised radiator element being provided, of which one polarisation is powered together with corresponding radiator devices in the first column and of which the other polarisation plane is in each case powered together with corresponding radiators in the second antenna column.

The following refers to FIG. 9, which basically shows a variant of FIG. 7.

The embodiment of FIG. 9 differs from that of FIG. 7 only in that now, the two first radiator devices 103*a* uppermost in each antenna column, i.e. the first radiator device 103*a* in the left column 7*a* and the first radiator device 103*a* radiating in the polarisation P2 perpendicular thereto in the right column 7*b*, are combined to form a common dual-polarised radiator device 103'*a*. In this case, the radiator element 103*a*, as it radiates in the first polarisation plane P1, is powered via the relevant network N2, which also powers the radiator devices 3 in the same antenna column 7*a* and aligned in the same polarisation plane P1, whilst the first radiator device 103*a* in the second column 7*b*, which radiates in the second polarisation plane P2, is powered via the network N11, which also jointly powers the radiator elements of the second radiator device 3 radiating in this polarisation plane P2. The same applies to the lowermost, third radiator devices 103*b* in each of the first and the second columns 7*a*, 7*b*, which in the variant of FIG. 9 are also combined to form a dual-polarised radiator device 103'*b*, and the corresponding polarisation planes are also powered via the associated networks N1 and N22 respectively.

The invention claimed is:

1. Dual polarized group antenna, in particular a mobile communications antenna, comprising:

a plurality of radiator devices which radiate in one polarization plane (P1) and/or in a polarization plane (P2) perpendicular thereto, at least one first radiator device, at least one second radiator device and at least one third radiator device, the at least one first radiator device and the at least one second radiator device and the at least one third radiator device being arranged consecutively, the at least one dual polarized radiator device structured to radiate in both polarization planes (P1, P2)

the at least one first radiator device structured to radiate only in one polarization plane (P1 or P2), and the at least one third radiator device structured to radiate in one polarization plane (P2 or P1), which is aligned perpendicular to the polarization plane in which the at least one first radiator device radiates.

2. Antenna array according to claim 1, wherein:

the antenna array comprises n radiators or radiator devices which radiate in one polarization plane (P1) and n radiators or radiator devices which radiate in the polarization plane (P2) perpendicular thereto, where n is an integer greater than 1, of the n radiators or radiator devices, m second radiators or radiator devices are provided and are formed as dual-polarized radiator devices, m being an integer smaller than n, n-m first radiators or radiator devices; and n-m third radiators or radiator devices are provided, and the at least one radiator device radiating in one polarization plane (P1 or P2) is arranged offset from the at least one dual-polarized second radiator device in one installation direction, and the at least one radiator device radiating in the other polarization plane (P2 or P1) is arranged offset from the at least one dual-polarized second radiator device in the opposite installation direction.

3. Antenna array according to claim 1, wherein:

the antenna array comprises, mutually offset in the installation direction or at least mutually offset in the installation direction by one component, two remote antenna regions (X1, X3), comprising a first antenna region (X1) and a third antenna region (X3), and a second antenna region (X2) arranged approximately centrally between them, a network (N1, N2; N11, N22) being provided to power each polarization (P1, P2), the at least one or the preferably at least a plurality of radiators, powered via a network (N1 or N11), in the first radiator region (X1) radiate only in one polarization plane (P1), the at least one or the preferably a plurality of radiators in the central radiator region (X2) radiate in both polarization planes (P1 or P2), and the at least one and the preferably a plurality of radiators in the third radiator region (X3) radiate only in the polarization plane (P2 or P1) perpendicular to the first radiator region (X1).

4. Antenna array according to claim 1, wherein the radiators radiating only in one polarization plane (P1 or P2) are formed as single-polarized dipole radiators.

5. Antenna array according to claim 1, wherein the radiators radiating only in one polarization plane (P1 or P2) are formed as dual-polarized radiator devices, which are powered only in one polarization plane (P1 or P2).

6. Antenna array according to claim 1, wherein the distances (d) between the positions of the respectively adjacent radiators or radiator devices are the same.

7. Antenna array according to claim 1, wherein some of the distances (d) between the positions of the respectively adjacent radiators or radiator devices are the same and some are different.

8. Antenna array according to claim 1, wherein at least two groups (A, B) of radiators or radiator devices are arranged in the installation direction, the radiators or radiator devices of the first group (A) being powered by a respective network (N1, N2) for each polarization (P1, P2) and the radiators or radiator devices of the second group (B) being powered by a respective separate network (N11, N12) for the two polarization planes (P1, P2), dual-polarized radiator devices being provided in the region central between the first and the second groups (A, B), the radiators of which devices are powered for one polarization plane (P1 or P2) by one network (N1 or N2) of one group (A), whilst while the second polarization plane (P2 or P1) perpendicular thereto of the at least one identical dual polarized radiator device is powered via the network (N22, N11) of the second group (B).

9. Antenna array according to claim 1, wherein the antenna array is formed as a dual-band antenna array and in addition to the radiators and radiator devices for a higher frequency band ($F_h$) comprises single- or dual-polarized radiator devices for the lower frequency band (Fn), the distance between which is preferably twice the distance (d) between the positions of two adjacent radiators or radiator devices for the higher frequency band ($F_h$), the distance (d) corresponding to the distance (d) between two adjacent radiator positions.

10. Antenna array according to claim 1, wherein the antenna array comprises at least two antenna columns, in each of which antenna columns are provided radiators or radiator devices, of which at least a first, preferably uppermost and at least a third, preferably lowermost radiator device radiate in two mutually perpendicular single polarisation polarization planes (P1, P2), t while between these one or more radiator devices which radiate in both polarization planes (P1, P2) are provided.

11. Antenna array according to claim 10, wherein the at least one first radiator device, which is powered via a network (N2) associated therewith, together with at least one radiator device in the first antenna column, and at least one further first radiator device, which is powered via a separate network (N11) together with at least one second radiator device in the second antenna column, form a combined dual polarized radiator device.

12. Antenna array according to claim 10, wherein the at least one third radiator device, which is powered via a network (N1) associated therewith, together with at least one radiator device in the first antenna column, and at least one further third radiator device, which is powered via a separate network (N22) together with at least one second radiator device in the second antenna column, form a combined dual-polarized radiator device.

13. Antenna array according to claim 1, wherein the two polarizations (P1, P2) are formed as linear polarizations.

14. Antenna array according to claim 1, wherein the two polarization planes (P1, P2) are aligned at an angle of +45° and −45° respectively to a horizontal plane and/or a vertical plane.

* * * * *